US011248611B2

(12) United States Patent
Hashizume et al.

(10) Patent No.: US 11,248,611 B2
(45) Date of Patent: Feb. 15, 2022

(54) CONTROL DEVICE FOR GENERAL PURPOSE ENGINE

(71) Applicant: HONDA MOTOR CO., LTD., Tokyo (JP)

(72) Inventors: Takashi Hashizume, Wako (JP); Hisanori Kanayama, Wako (JP); Akifumi Fujima, Wako (JP); Keiichiro Bungo, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 257 days.

(21) Appl. No.: 16/344,700

(22) PCT Filed: May 9, 2017

(86) PCT No.: PCT/JP2017/017491
§ 371 (c)(1),
(2) Date: Apr. 24, 2019

(87) PCT Pub. No.: WO2018/207246
PCT Pub. Date: Nov. 15, 2018

(65) Prior Publication Data

US 2020/0049154 A1 Feb. 13, 2020

(51) Int. Cl.
*F04D 15/02* (2006.01)
*F02D 29/04* (2006.01)
(Continued)

(52) U.S. Cl.
CPC ..... *F04D 15/0281* (2013.01); *F02D 29/04* (2013.01); *F04B 23/02* (2013.01);
(Continued)

(58) Field of Classification Search
CPC ..... F04D 13/12; F04D 13/16; F04D 15/0218; F04D 15/0281; F04B 17/05; F04B 23/02;
(Continued)

(56) References Cited

U.S. PATENT DOCUMENTS 5,336,054 A * 8/1994 Seah ..... G05D 9/12 417/2
6,651,900 B1 11/2003 Yoshida
(Continued)

FOREIGN PATENT DOCUMENTS

JP 8-308950 11/1996
JP H9-154974 6/1997
(Continued)

OTHER PUBLICATIONS

Machine Translation of JP2002005076.*
International Search Report, dated Jul. 18, 2017 (Jul. 17, 2018), 1 page.
European Search Report dated Mar. 25, 2020. 8 pages.

*Primary Examiner* — Christopher S Bobish
(74) *Attorney, Agent, or Firm* — Rankin, Hill & Clark LLP

(57) ABSTRACT

A general-purpose engine control device capable of improving operation efficiency when transferring a liquid using a plurality of liquid pumps and containers. In a liquid transfer system that transfers water of a river to a container by way of a liquid pump, a container, a liquid pump, and a liquid pump in this order, an engine device has a communication interface for performing communication with another engine device, and transmits, after the driving of a liquid pump is started, start instruction information instructing the start of driving a liquid pump to an engine device installed next to the liquid pump on a downstream side in a water transferring direction on the basis of information indicating a driving record of the liquid pump. In an engine pump having received the start instruction information, the driving of the liquid pump is started.

9 Claims, 6 Drawing Sheets

(51) Int. Cl.

| | |
|---|---|
| ***F04D 13/12*** | (2006.01) |
| ***F04B 23/02*** | (2006.01) |
| ***F04D 13/16*** | (2006.01) |
| ***F04B 23/04*** | (2006.01) |
| ***F04B 17/05*** | (2006.01) |
| ***A62C 35/00*** | (2006.01) |
| ***E03B 5/02*** | (2006.01) |
| ***E03B 5/04*** | (2006.01) |

(52) U.S. Cl.
CPC ..... *F04B 23/025* (2013.01); *F04B 23/04* (2013.01); *F04D 13/12* (2013.01); *F04D 13/16* (2013.01); *F04D 15/0218* (2013.01); *A62C 35/00* (2013.01); *E03B 5/025* (2013.01); *E03B 5/045* (2013.01); *F04B 17/05* (2013.01)

(58) Field of Classification Search
CPC ..... F04B 23/025; F04B 23/04; F02D 29/04; A62C 35/00; A62C 27/00; E03B 5/025; E03B 5/045
USPC ..... 417/1, 2, 36
See application file for complete search history.

(56) References Cited

U.S. PATENT DOCUMENTS

| | | | | |
|---|---|---|---|---|
| 7,793,509 | B2 * | 9/2010 | Crane | F25B 49/025 62/175 |
| 8,545,189 | B2 * | 10/2013 | Venkatachari | F04D 15/0218 417/36 |
| 2004/0065450 | A1 | 4/2004 | Yoshida | |
| 2004/0244996 | A1 | 12/2004 | Kravkov | |
| 2006/0180321 | A1 | 8/2006 | Yoshida | |
| 2009/0304521 | A1 * | 12/2009 | Kernan | F04D 15/0072 417/2 |
| 2020/0408215 | A1 * | 12/2020 | Younker | F04D 13/021 |

FOREIGN PATENT DOCUMENTS

| | | | |
|---|---|---|---|
| JP | 10015105 | A * | 1/1998 |
| JP | 2001-149494 | | 6/2001 |
| JP | 2002-005076 | | 1/2002 |
| JP | 2002005076 | A * | 1/2002 |
| JP | 2011-087621 | | 5/2011 |
| JP | 2014-181556 | | 9/2014 |

* cited by examiner

CONTROL DEVICE FOR GENERAL PURPOSE ENGINE

TECHNICAL FIELD

The present invention relates to a control device for a general purpose engine to be used as a power source for a liquid pump.

BACKGROUND ART

Patent Document 1 discloses a relayed water transfer system that transfers water over a long distance by connecting a plurality of engine pumps in series via hoses. In this system, a communicating function is provided to each of the engine pumps, and an engine having excess power generates electric power to be supplied to another other engine having no excess power.

PRIOR ART DOCUMENT

Patent Document

Patent Document 1: JP-A-2014-181556

SUMMARY OF THE INVENTION

Problem to be Solved by the Invention

As a method for transferring liquid to a distant location by a plurality of liquid pumps, the following method can be thought of in addition to the method disclosed by Patent Document 1 in which the plurality of engine pumps are connected in series by the hoses.

That is, liquid is suctioned by an engine pump and delivered to a container and the liquid in the container is then suctioned by another engine pump to be delivered to another container. These operations are performed repeatedly.

In this method, for example, in the case where the engine pump placed in the most upstream position in the liquid transferring direction and the engine pump placed in the most downstream position in the liquid transferring direction are operated at the same time, the engine pump placed in the engine pump in the most downstream position may perform a suctioning operation in a state where no liquid exists in the corresponding container, and hence, energy is wasted on the downstream engine pump.

Such waste of energy can be avoided by working people controlling the start of respective suctioning operations of the engine pumps in accordance with a stage of transfer of water. However, when water is transferred over a long distance, the number of working people involved has to be increased, or the working people have to move between the engine pumps repeatedly, which causes an increase in labor cost or a reduction in working efficiency.

The present invention has been made in view of the situations described above, and an object thereof is to provide a control device for a general purpose engine that can improve working efficiency in transferring liquid by use of pluralities of liquid pumps and containers.

Means for Solving the Problem

The above object may be achieved by the following.

A control device for a general purpose engine in a system (for example, a liquid transferring system 100 in an embodiment described below) including a plurality of liquid pumps (for example, liquid pumps 1A in the embodiment) that are placed to be spaced from one another and a plurality of general purpose engines (for example, general purpose engines 11 in the embodiment) for driving the plurality of liquid pumps, respectively, wherein liquid existing in a first place (for example, a river RV in the embodiment) is transferred to a second place (for example, a container 4E in the embodiment) by transferring the liquid through the liquid pumps and at least one container (for example, containers 2E, 3E in the embodiment) alternately, the control device comprising:

a communication interface (for example, a communication I/F 13 in the embodiment) configured to communicate with another control device for another general purpose engine; and a start instruction information sending unit (for example, a start instruction information sending unit 142 in the embodiment) configured to send, after a first liquid pump that is to be driven by the own control device is started to be driven, start instruction information to a second control device that drives a second liquid pump placed adjacent to a downstream side of the first liquid pump in a transferring direction of the liquid to instruct the second control device to start driving of the second liquid pump based on information indicating a driving record of the first liquid pump, wherein the second liquid pump is started to be driven by the second control device that receives the start instruction information.

Advantages of the Invention

According to the above configuration, the start instruction information instructing to start driving of the second liquid pump placed adjacent to the downstream side of the first liquid pump in the transferring direction of the liquid is sent to the second control device that drives the second liquid pump based on the driving record of the first liquid pump, and the second liquid pump is started to be driven by the second control device that receives the start instruction information. Accordingly, the necessity of the working person operating the liquid pumps placed to be spaced from one another to start driving of them can be avoided, so that the working efficiency can be improved.

DETAILED DESCRIPTION

Hereinafter, an embodiment of the invention will be described by reference to the drawings.

Figure 1:
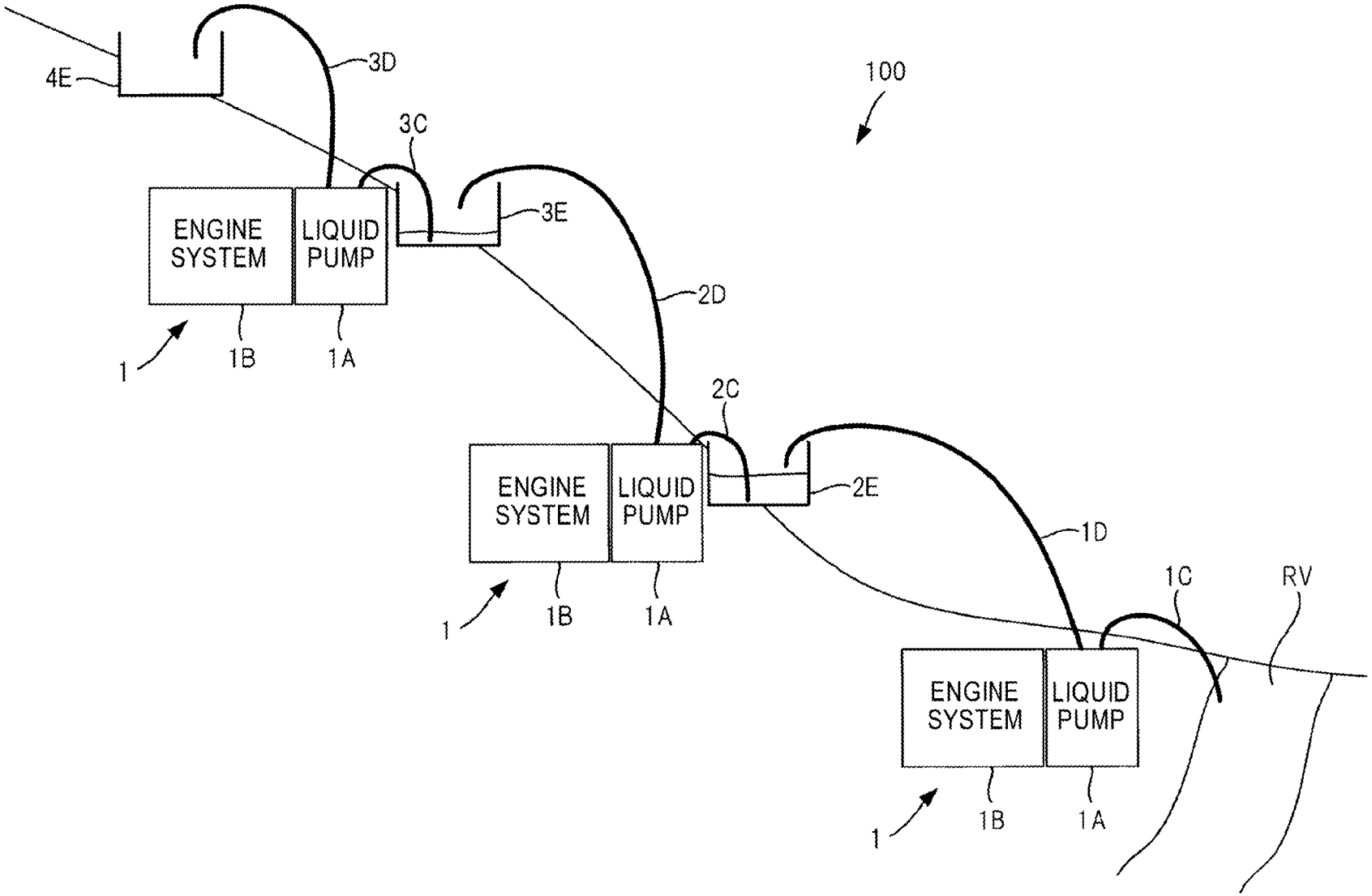
FIG. 1 is a schematic diagram showing a schematic configuration of a liquid transferring system 100.

FIG. 1 is a schematic diagram showing a schematic configuration of a liquid transferring system 100.

The liquid transferring system 100 is a system for transferring water from a river RV to a container 4E placed on a hill that is distant from the river RV. The river RV is an example of a first place, and the container 4E is an example of a second place. The river RV may be a pond where water is reserved, a pool where water is stored or a container where water is stored.

The liquid transferring system 100 includes containers 2E, 3E, 4E of an arbitrary shape, three engine pumps 1, hoses 1C, 1D, hoses 2C, 2D and hoses 3C, 3D.

The container 2E is placed in a position higher in altitude than the river RV. The container 3E is placed in a position higher in altitude than the container 2E. The container 4E is placed in a position higher in altitude than the container 3E.

The engine pumps 1 are placed respectively beside the river RV, the container 2E and the container 3E. Accordingly, the three engine pumps 1 are placed between the river RV and the container 4E to be spaced from one another.

The engine pumps 1 each includes a liquid pump 1A and an engine system 1B which includes a general purpose engine for driving the liquid pump 1A.

The hose 1C is connected to a liquid suction port of the liquid pump 1A placed beside the river RV at one end thereof and the other end of the hose 1C is placed in the river RV. The hose 1D is connected to a liquid discharge port of the liquid pump 1A placed beside the river RV at one end thereof and the other end of the hose 1D is placed in the container 2E.

The hose 2C is connected to a liquid suction port of the liquid pump 1A placed beside the container 2E at one end thereof and the other end of the hose 2C is placed in the container 2E. The hose 2D is connected to a liquid discharge port of the liquid pump 1A placed beside the container 2E at one end thereof and the other end of the hose 2D is placed in the container 3E.

The hose 3C is connected to a liquid suction port of the liquid pump 1A placed beside the container 3E at one end thereof and the other end of the hose 3C is placed in the container 3E. The hose 3D is connected to a liquid discharge port of the liquid pump 1A placed beside the container 3E at one end thereof and the other end of the hose 3D is placed in the container 4E.

In the liquid transferring system 100, water suctioned from the river RV by the liquid pump 1A placed beside the river RV is transferred to the container 2E. Water stored in the container 2E is suctioned by the liquid pump 1A placed beside the container 2E and is then transferred to the container 3E. Water stored in the container 3E is suctioned by the liquid pump 1A placed beside the container 3E and is then transferred to the container 4E.

Accordingly, water in the river RV is transferred into the container 4E placed in the position at a high altitude above the river RV by transferring the water to the container 4E through the three liquid pumps 1A and the containers 2E, 3E one after another alternately.

A direction in which the river RV, the container 2E, the container 3E and the container 4E are connected together sequentially in this order constitutes a direction in which water in the river RV is transferred by the liquid transferring system 100 (hereinafter, simply referred to as a transferring direction).

In the example shown in FIG. 1, the liquid transferring system 100 includes the two containers and the three engine pumps 1 between the river RV and the container 4E. However, at least one container and at least two engine pumps 1 should be placed between the river RV and the container 4E.

For example, in FIG. 1, a system configuration may be adopted in which the container 4E and the engine pump 1 placed beside the container 3E are omitted, so that the container 3E is regarded as a final place for water to be transferred.

Figure 2:
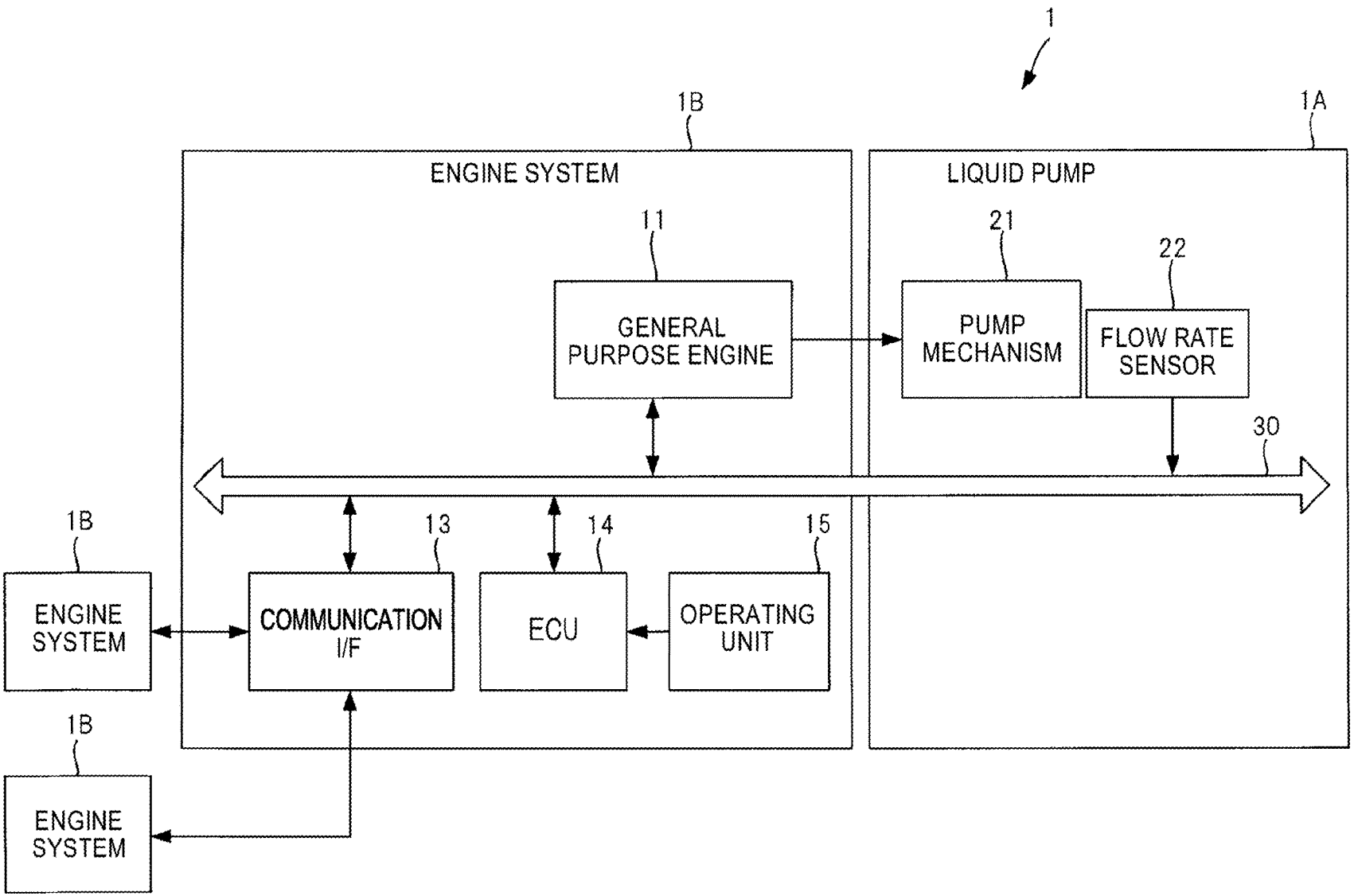
FIG. 2 is a block diagram schematically showing a detailed configuration of an engine pump 1 shown in FIG. 1.

FIG. 2 is a block diagram schematically showing a detailed configuration of the engine pump 1 shown in FIG. 1.

As shown in FIG. 2, the engine system 1B includes a general purpose engine 11 that constitutes a power source for the liquid pump 1A, a communication interface (I/F) 13, an Electronic Control Unit (ECU) 14, and an operating unit 15. The ECU 14, the communication I/F 13 and the operating unit 15 constitute a control device for the general purpose engine 11.

The general purpose engine 11 is configured by an air-cooled, two- or four-cycle, single-cylinder engine using, for example, gasoline as a fuel thereof. The general purpose engine 11 is connected to a bus 30 and is controlled by the ECU 14.

The communication I/F 13 is an interface for performing a near field communication with electronic device including another engine system 1B included in the liquid transferring system 100.

The near field communication refers to a communication that complies with a communication standard that permits a direct communication between communication devices without involving a network such as the Internet. A communication interface complying with Bluetooth (Registered Trademark) or WiFi may be used as the interface for near field communication.

The communication I/F 13 is connected to the bus 30 and is controlled by the ECU 14.

The operating unit 15 is hardware for variously operating the engine pump 1 and includes a power supply button for starting and stopping the engine system 1B, a suction start and end button for issuing instructions to start and stop a suction of liquid by the liquid pump 1A, a keyboard for inputting information and the like. The operating unit 15 may be provided on the liquid pump 1A.

The ECU 14 is configured by a microcomputer including a processor, a Read Only Memory (ROM) in which a control program to be executed by the processor and the like are stored and a Random Access Memory (RAM). The ECU 14 operates using electric power of a battery (not shown) that is charged with power of the general purpose engine 11.

When an instruction to start the ECU 14 is issued by operating the power supply button of the operating unit 15, the ECU 14 is started by electric power supplied from the battery and controls the communication I/F 13 to realize a state in which the ECU 14 can communicate with another electronic device.

While the general purpose engine 11 is being driven, the ECU 14 controls the position of a throttle valve included in the general purpose engine 11 based on a detection signal from a flow rate sensor 22 provided in the liquid pump 1A, which will be described later, so that a liquid delivery amount per unit time of the liquid pump 1A becomes a desired target value.

The liquid pump 1A includes a pump mechanism 21 and the flow rate sensor 22.

The pump mechanism 21 includes a casing having two opening portions of a liquid inlet port and a liquid outlet port, and an impeller that is disposed within the casing to be rotated by the power of the general purpose engine 11, so that the pump mechanism 21 delivers liquid flowing into the casing from the liquid inlet port from the liquid outlet port.

The flow rate sensor 22 is placed near the liquid outlet port of the pump mechanism 21 to detect a delivery amount per unit time (for example, one second) of liquid delivered from the liquid outlet port of the pump mechanism 21. Information on this delivery amount is transmitted to the ECU 14 of the engine system 1B via the bus 30.

In the liquid transferring system 100, information indicating a position where each engine pump 1 is placed can be registered for each of the three engine pumps 1.

For example, when a working person operates an electronic device such as a personal computer or a smartphone in which a dedicated application program is installed in order to designate an order in which the three engine pumps 1 are arranged in the transferring direction on a screen of the electronic device, the information on the positions of the three engine pumps 1 is transmitted to the communication I/F 13 of each of the engine pumps 1 from the electronic device. The ECUs 14 of the engine pumps 1 each store the information on the pump positions in the RAM thereof to recognize the position of the own engine pump and the positions of the other engine pumps.

In the three engine pumps 1, each engine pump 1 is paired with the others by the function of this application program.

In the following description, in relation to the positions of the engine pumps 1 in the liquid transferring system 100, a most upstream position in the transferring direction is referred to as an upstream position, a most downstream position in the transferring direction is referred to as a downstream position, and a position between the upstream position and the downstream position in the transferring direction is referred to as a middle position.

A configuration may be adopted in which a button for starting pairing with the other engine pump 1 is provided in the operating unit 15 of each engine pump 1 such that pairing with the near engine pump 1 is performed when the button is depressed.

The pump position information may be inputted directly from the keyboard of the operating unit 15 of each engine pump 1.

Numbers increasing in the order of the upstream position, the middle position and the downstream position may be registered, and these numbers may be registered as the pump position information.

In each engine pump 1, when a number is inputted, transmission data including the number and its own ID is created, and the created transmission data is sent to the other engine pumps 1. This enables the ECU 14 of each engine pump 1 to recognize the position of the own engine pump 1 and the positions of the other engine pumps 1.

In the example shown in FIG. 1, the engine pump 1 beside the river RV is the engine pump placed in the upstream position, the engine pump 1 beside the container 2E is the engine pump placed in the middle position, and the engine pump 1 beside the container 3E is the engine pump placed in the downstream position.

Figure 3:
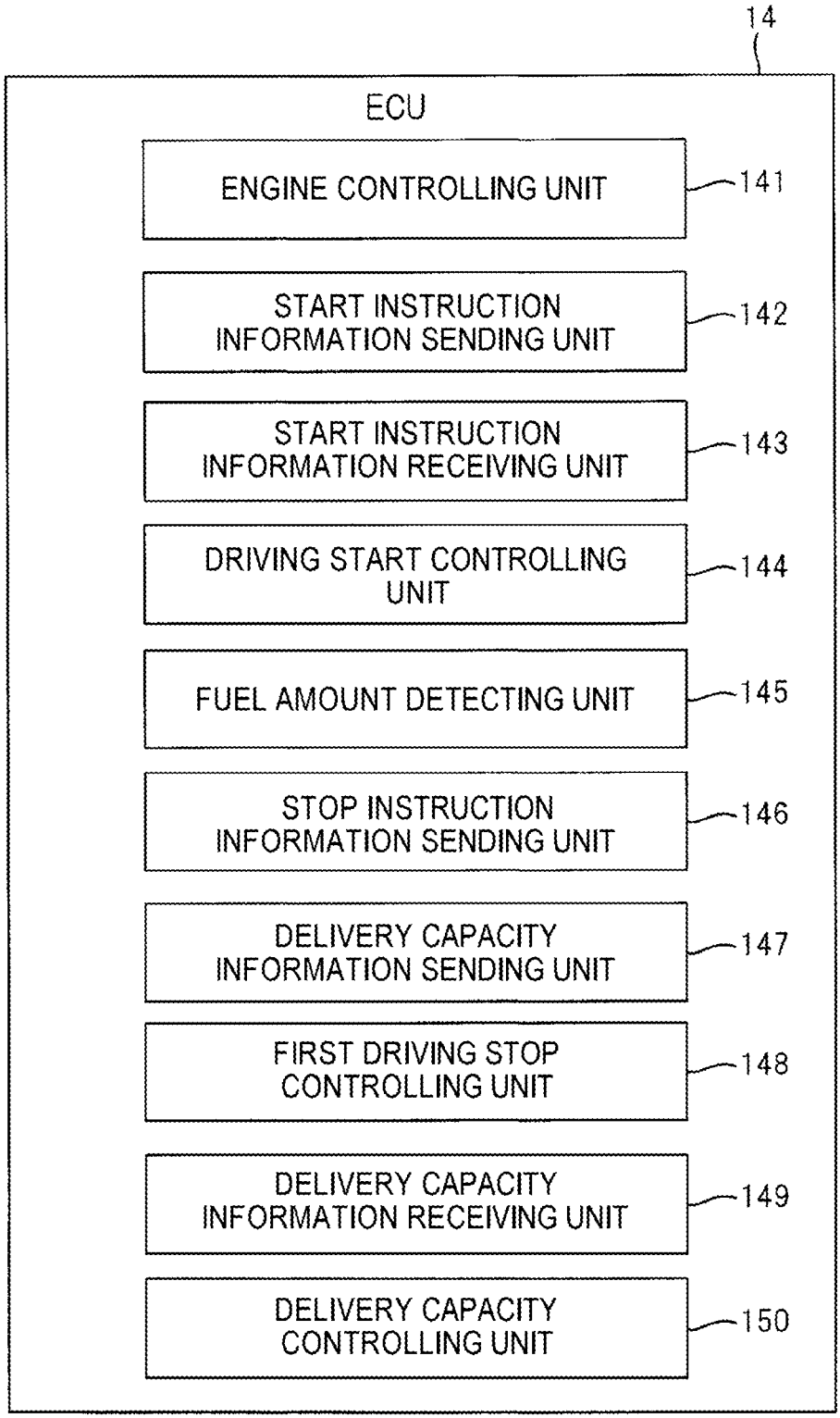
FIG. 3 is a functional block diagram of an ECU 14 of the engine pump 1 in the liquid transferring system 100 shown in FIG. 1.

FIG. 3 is a functional block diagram of then ECU 14 of the engine pump 1 in the liquid transferring system 100 shown in FIG. 1.

The ECU 14 of the engine pump 1 functions, in association with the processor executing a control program to operate with various types of hardware, as an engine controlling unit 141, a start instruction information sending unit 142, a start instruction information receiving unit 143, a driving start controlling unit 144, a fuel amount detecting unit 145, a stop instruction information sending unit 146, a delivery capacity information sending unit 147, a first driving stop controlling unit 148, a delivery capacity information receiving unit 149 and a delivery capacity controlling unit 150.

The engine controlling unit 141 starts the general purpose engine 11 to start driving of the liquid pump 1A when a suction start instruction is given by operating the suction start and end button of the operating unit 15.

After the liquid pump 1A is started to be driven, the start instruction information sending unit 142 sends start instruction information to the engine pump 1 placed adjacent to a downstream side of the own engine pump in the transferring direction to start driving of the liquid pump 1A thereof based on information indicating a driving record of the liquid pump 1A.

The driving record of the liquid pump 1A is an accumulated delivery amount or operating time of the liquid pump 1A. The accumulated delivery amount is obtained by multiplying a delivery amount per unit time that is detected by the flow rate sensor 22 by the operating time.

The position of the throttle valve of the general purpose engine 11 is associated with a delivery amount detected by the flow rate sensor 22, and hence, the accumulated delivery amount can also be obtained from a record of positions of the throttle valve of the general purpose engine 11.

The start instruction information sending unit 142 sends the start instruction information to the engine system 1B of the engine pump 1 placed adjacent to the downstream side of the own engine pump in the transferring direction when the information indicating the driving record reaches a first threshold that is determined in advance.

A time required from the start of transfer of water by the engine pump 1 until a sufficient amount of water is stored in the destination container to which water is transferred is set for the first threshold. The sufficient amount of water refers to, for example, an amount of water by which a tip end of the hose that is connected to the adjacent liquid pump 1A fully submerges.

The start instruction information receiving unit 143 receives start instruction information that is sent from the start instruction information sending units 142 of the other engine pumps 1.

When the start instruction information receiving unit 143 receives the start instruction information, the driving start controlling unit 144 starts the general purpose engine 11 to start driving of the liquid pump 1A.

The fuel amount detecting unit 145 detects an amount of fuel remaining in the general purpose engine 11 from information from a sensor (now shown).

The stop instruction information sending unit 146 stops the driving of the liquid pump 1A and sends stop instruction information to stop the driving of the liquid pumps 1A to the engine systems 1B of all the engine pumps 1 that are placed upstream of the own engine pump in the transferring direction via the communication I/F 13 when the amount of fuel remaining in the liquid pump 1A that is detected by the fuel amount detecting unit 145 is below a second threshold determined in advance while the liquid pump 1A is being driven.

For example, a minimum amount of fuel that is required to drive the liquid pump 1A is set for the second threshold.

When the liquid pump 1A is started to be driven by the driving start controlling unit 144, the delivery capacity information sending unit 147 sends information on a delivery capacity of water of the liquid pump 1A to the engine system 1B of the engine pump 1 placed adjacent to an upstream side of the own engine pump in the transferring direction via the communication I/F 13.

The information on the delivery capacity of the liquid pump 1A is information on, for example, a delivery amount per unit time that is detected by the flow rate sensor 22 or the position of the throttle valve of the general purpose engine 11.

The first driving stop controlling unit 148 stops the driving of the general purpose engine 11 to stop the liquid pump 1A when stop instruction information is sent thereto from the other engine pumps 1.

The delivery capacity information receiving unit 149 receives delivery capacity information sent from the delivery capacity information sending units 147 of the other engine pumps 1 via the communication I/F 13.

The delivery capacity controlling unit 150 controls the delivery capacity of the liquid pump 1A based on the delivery capacity information received at the delivery capacity information receiving unit 149.

Specifically, the delivery capacity controlling unit 150 perform control such that the delivery capacity of the liquid pump 1A of the own engine pump coincides with the delivery capacity of the liquid pump 1A placed adjacent to a downstream side of the liquid pump 1A of the own engine pump in the transferring direction in the case where the delivery capacity of the liquid pump 1A placed adjacent to the downstream side of the liquid pump 1A of the own engine pump in the transferring direction is higher than the delivery capacity of the liquid pump 1A of the own engine pump and where the liquid pump 1A on the downstream side of the liquid pump 1A of the own engine pump performs a suctioning operation in a state where only a small amount of water is stored in the corresponding container.

Additionally, the delivery capacity controlling unit 150 performs control such that the delivery capacity of the liquid pump 1A of the own engine pump is reduced in the case where the delivery capacity of the liquid pump 1A placed adjacent to the downstream side of the liquid pump 1A of the own engine pump in the transferring direction is lower than the delivery capacity of the liquid pump 1A of the own engine pump and where there is a possibility that water overflows from the destination container to which water is transferred by the own engine pump.

Figure 4:
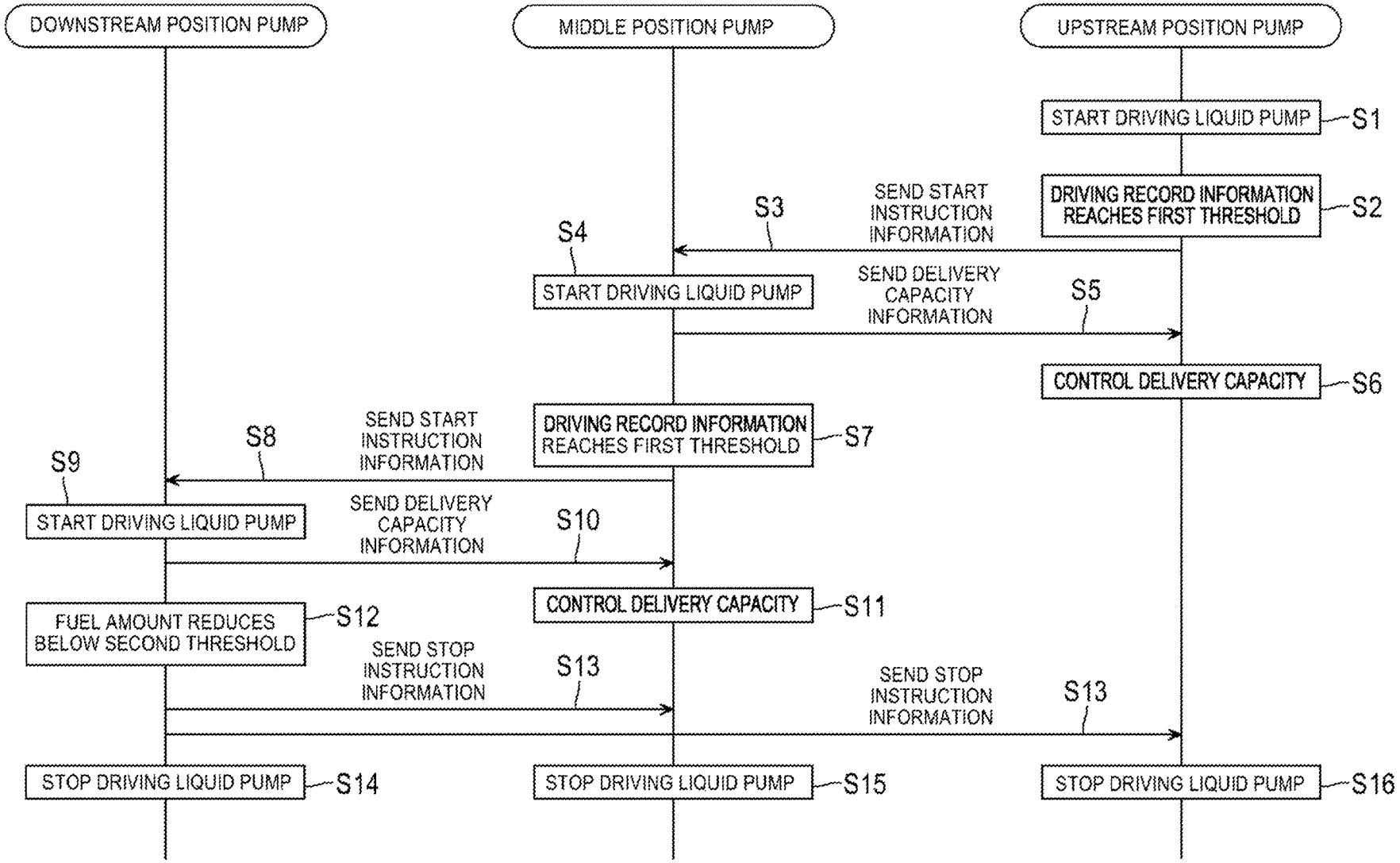
FIG. 4 is a sequence chart illustrating operations of the liquid transferring system 100 shown in FIG. 1.

FIG. 4 is a sequence chart illustrating operations of the liquid transferring system 100 shown in FIG. 1.

A flow of an "upstream position pump" shown in FIG. 4 shows operations of the engine pump 1 disposed beside the river RV shown in FIG. 1. A flow of a "middle position pump" shown in FIG. 4 shows operations of the engine pump 1 disposed beside the container 2E shown in FIG. 1. A flow of a "downstream position pump" shown in FIG. 4 shows operations of the engine pump 1 disposed beside the container 3E shown in FIG. 1.

Firstly, the working person operates the power supply buttons of the engine pumps 1 to start the ECUs 14 of the engine pumps 1 and sets the engine pumps 1 in a standby state. In this state, the working person operates the electronic device to perform an operation of joining the three engine pumps 1 included in the liquid transferring system 100 to form pairs and an operation of registering the pump position information.

By performing these operations, each engine pump 1 can communicate with the other engine pumps 1, and the information on the respective positions of the three engine pumps 1 is registered in the respective RAMs of the ECUs 14 of the engine pumps 1.

Next, the working person operates the suction start and end button of the engine pump 1 in the upstream position and instructs the engine pump 1 to start suctioning. In the engine pump 1 in the upstream position that receives this instruction, the engine controlling unit 141 starts the general purpose engine 11 to start driving of the liquid pump 1A (Step S1).

This starts transferring water in the river RV by the use of the liquid pump 1A of the engine pump 1 in the upstream position. When the liquid pump 1A is started to be driven, in the engine pump 1 in the upstream position, the start instruction information sending unit 142 monitors the driving record (for example, an accumulated delivery amount) of the liquid pump 1A and determines whether this accumulated delivery amount reaches the first threshold.

Then, when the accumulated delivery amount reaches the first threshold (Step S2), the start instruction information sending unit 142 of the engine ump 1 in the upstream position sends start instruction information to the engine system 1B of the engine pump 1 in the middle position (Step S3).

The start instruction information sent in Step S3 is received by the start instruction information receiving unit 143 of the engine pump 1 in the middle position. Then, in the engine pump 1 in the middle position, the driving start controlling unit 144 starts the general purpose engine 11 to start driving of the liquid pump 1A (Step S4).

When the liquid pump 1A is started to be driven in Step S4, the delivery capacity information sending unit 147 of the engine pump 1 in the middle position obtains information on the delivery capacity of the liquid pump 1A of the own engine pump and sends this information to the engine system 1B of the engine pump 1 placed in the upstream position (Step S5).

This delivery capacity information is received by the delivery capacity information receiving unit 149 of the engine pump 1 placed in the upstream position. Then, in the engine pump 1 placed in the upstream position, the delivery capacity controlling unit 150 controls the delivery capacity of the liquid pump 1A based on the received delivery capacity information (Step S6).

When the liquid pump 1A is started to be driven in Step S4, in the engine pump 1 placed in the middle position, the start instruction information sending unit 142 monitors the driving record (for example, an accumulated delivery amount) of the liquid pump 1A and determines whether this accumulated delivery amount reaches the first threshold.

Then, when the accumulated delivery amount reaches the first threshold (Step S7), the start instruction information sending unit 142 of the engine pump 1 placed in the middle position sends start instruction information to the engine system 1B of the engine pump 1 in the downstream position (Step S8).

The start instruction information sent in Step S8 is received by the start instruction information receiving unit 143 of the engine pump 1 placed in the downstream position. Then, in the engine pump 1 placed in the downstream position, the driving start controlling unit 144 starts the general purpose engine 11 to start driving of the liquid pump 1A (Step S9).

When the liquid pump 1A is started to be driven in Step S9, in the engine pump 1 placed in the downstream position, the delivery capacity information sending unit 147 obtains information on the delivery capacity of the liquid pump 1A and sends this information to the engine system 1B of the engine pump 1 placed in the middle position (Step S10).

This delivery capacity information is received by the delivery capacity information receiving unit 149 of the engine pump 1 placed in the middle position. Then, in the engine pump 1 placed in the middle position, the delivery capacity controlling unit 150 controls the delivery capacity of the liquid pump 1A based on the received delivery capacity information (Step S11).

After Step S9, when the fuel amount detecting unit 145 of the engine pump 1 placed in the downstream position detects that the amount of fuel in the general purpose engine 11 is reduced to an amount below the second threshold (Step S2), the stop instruction information sending unit 146 of the engine pump 1 placed in the downstream position stops the general purpose engine 11 to stop driving the liquid pump 1A (Step S14).

In parallel with the operation in Step S14, the stop instruction information sending unit 146 of the engine pump 1 placed in the downstream position sends stop instruction information that gives an instruction to stop the liquid pump to the engine system 1B of the engine pump 1 placed in the middle position and the engine system 1B of the engine pump 1 placed in the upstream position (Step S13).

In the engine pump 1 placed in the middle position that receives the stop instruction information sent in Step S13, the first driving stop controlling unit 148 stops the general purpose engine 11 to stop the liquid pump 1A (Step S15).

Similarly, in the engine pump 1 placed in the upstream position that receives the stop instruction information sent in Step S13, the first driving stop controlling unit 148 stops the general purpose engine 11 to stop the liquid pump 1A (Step S16).

Thus, as has been described heretofore, according to the liquid transferring system 100, a suctioning operation by the engine pump 1 placed in the middle position and a suctioning operation by the engine pump 1 placed in the downstream position are started sequentially in an automatic manner only by the working person operating the suction start and end button of the engine pump 1 placed in the upstream position to start a suctioning operation. Accordingly, the necessity of placing working persons in the middle position and the downstream position can be avoided, so that the operation costs can be reduced.

In addition, according to the liquid transferring system 100, the delivery capacity of the liquid pump 1A of one of the engine pumps 1 is controlled based on the delivery capacity of the liquid pump 1A of the engine pump 1 placed adjacent to the downstream side of the own engine pump 1 in the transferring direction. This enables the engine pumps 1 other than the engine pump 1 placed in the downstream position to operate efficiently to match the situations of the respective destinations to which water is transferred.

For example, even in a case where respective volumetric capacities of the container 2E and the container 3E are smaller than a volumetric capacity of the container 4E, the delivery capacities of the engine pumps 1 can be controlled such that water does not overflow from the container 2E and the container 3E. Consequently, containers having a great volumetric capacity do not have to be prepared for the container 2E and the container 3E, so that the overall costs of the liquid transferring system 100 can be reduced.

In addition, according to the liquid transferring system 100, in the case where the fuel amount of the general purpose engine 11 of one of the engine pumps 1 is reduced to be below the second threshold, the suctioning operations by all the engine pumps 1 that are placed upstream of the one engine pump 1 in the transferring direction are stopped.

For example, in FIG. 1, in the case where the liquid pump 1A in the middle position cannot continue its suctioning operation due to insufficient fuel, the driving of the liquid pump 1A in the upstream position is stopped, so that water can be prevented from overflowing from the container 2E.

Even in this case, the liquid pump 1A in the downstream position can continue its suctioning operation, so that the transfer of water from the container 3E to the container 4E can continue.

The ECU 14 of the engine pump 1 that is lack of fuel preferably sends information requesting a supply of fuel to the electronic device that is used to set the pump position information via the communication I/F 13.

This allows the working person to recognize the lack of fuel, so that fuel is supplied again quickly to smoothly resume the water transferring operation.

Figure 5:
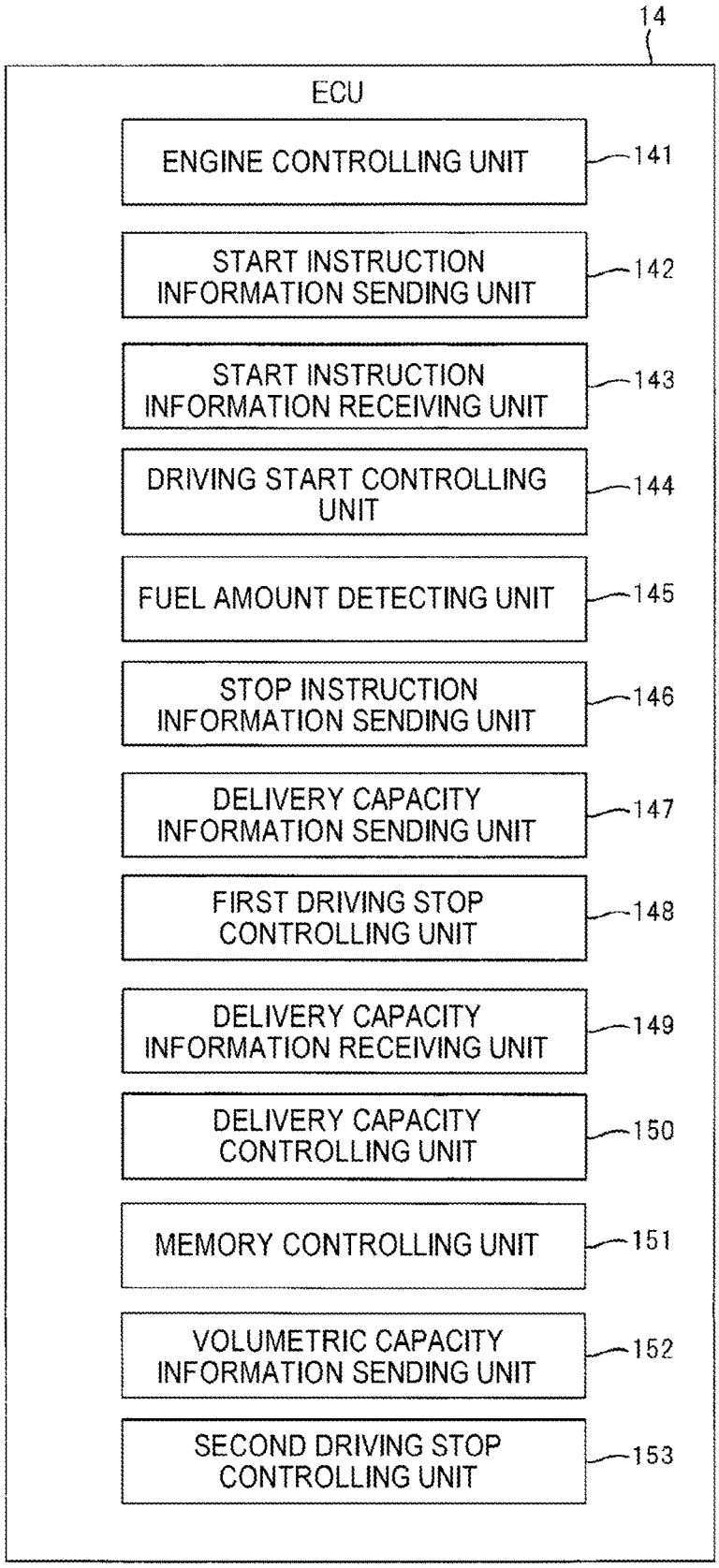
FIG. 5 is a diagram showing a modified example of a functional block diagram of an ECU 14 of the engine pump 1 in the liquid transferring system 100 shown in FIG. 1.

FIG. 5 is a diagram showing a modified example of a functional block diagram of an ECU 14 of the engine pump 1 in the liquid transferring system 100 shown in FIG. 1. In FIG. 5, the same reference numerals will be given to configurations similar to those shown in FIG. 3, and the description thereof will be omitted here.

An ECU 14 shown in FIG. 5 functions, in association with the processor executing a control program to operate with various types of hardware, as an engine controlling unit 141, a start instruction information sending unit 142, a start instruction information receiving unit 143, a driving start controlling unit 144, a fuel amount detecting unit 145, a stop instruction information sending unit 146, a delivery capacity information sending unit 147, a first driving stop controlling unit 148, a delivery capacity information receiving unit 149, a delivery capacity controlling unit 150, a memory controlling unit 151, a volumetric capacity information sending unit 152, and a second driving stop controlling unit 153.

When information on a volumetric capacity of the container 4E is inputted by operating the keyboard of the operating unit 15, the memory controlling unit 151 memorizes or stores this volumetric capacity information in the RAM.

In addition, when information on the volumetric capacity of the container 4E is sent thereto from the other engine systems 1B, the memory controlling unit 151 stores this volumetric capacity information in the RAM. The keyboard of the operating unit 15 is an example of an input interface.

When the information on the volumetric capacity of the container 4E is inputted by operating the ten keys of the operating unit 15, the volumetric capacity information sending unit 152 sends this volumetric capacity information to all the other engine systems 1B via the communication I/F 13.

The second driving stop controlling unit 153 stops driving the liquid pump 1A of the own engine pump when a difference between an accumulated delivery amount of liquid by the liquid pump 1A of the own engine pump and the volumetric capacity of the container 4E stored in the RAM (specifically, a value resulting from deducting the accumulated delivery amount from the volumetric capacity of the container 4E) becomes equal to or smaller than a third threshold that is determined in advance.

It is difficult for the liquid pump 1A to suction all water in the container, and therefore, a negative value that is slightly smaller than zero is set for the third threshold.

Figure 6:
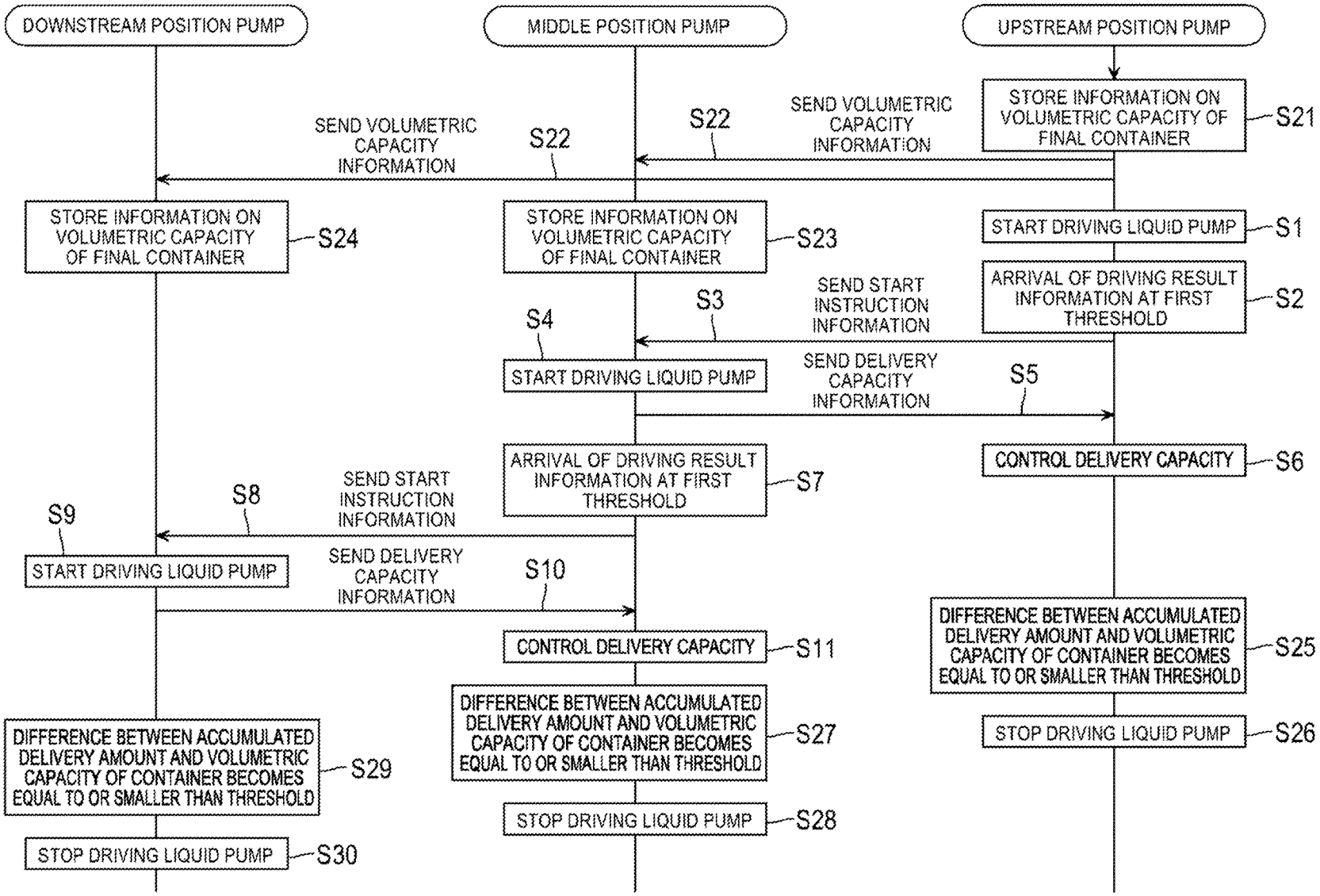
FIG. 6 is a sequence chart illustrating operations of the liquid transferring system 100 including the ECU 14 according to the modified example shown in FIG. 5.

FIG. 6 is a sequence chart illustrating operations of the liquid transferring system 100 including the ECU 14 of the modified example shown in FIG. 5. In FIG. 6, the same reference numerals will be given to operations similar to those shown in FIG. 4, and the description thereof will be omitted here.

Firstly, the working person operates the power supply buttons to start the ECUs 14 of the engine pumps 1 and sets the engine pumps 1 in a standby state.

In this state, the working person operates the electronic device to perform an operation of registering pump position information of the three engine pumps 1 included in the liquid transferring system 100. By performing this operation, the information on the positions where the three engine pumps 1 are placed is registered in the respective RAMs of the ECUs 14 of the engine pumps 1.

Next, the working person operates the keyboard of the engine pump 1 placed in the upstream position to input the volumetric capacity of the container 4E. When the volumetric capacity of the container 4E is inputted, information on this volumetric capacity is stored in the RAM by the memory controlling unit 151 of the engine pump 1 placed in the upstream position (Step S21).

In parallel with the operation in Step S21, the volumetric capacity information sending unit 152 of the engine pump 1 placed in the upstream position sends the inputted information on the volumetric capacity of the container 4E to the engine system 1B of the engine pump 1 placed in the middle position and the engine system 1B of the engine pump 1 placed in the downstream position (Step S22).

In the engine pump 1 placed in the middle position that receives the volumetric capacity information sent in Step S22, the memory controlling unit 151 stores this volumetric capacity information in the RAM (Step S23).

In the engine pump 1 placed in the downstream position that receives the volumetric capacity information sent in Step S22, the memory controlling unit 151 stores this volumetric capacity information in the RAM (Step S24).

Next, the working person operates the suction start and end button of the engine pump 1 in the upstream position and instructs the engine pump 1 to start suctioning. In the engine pump 1 placed in the upstream position, when receiving this instruction, the engine controlling unit 141 starts the general purpose engine 11 to start driving the liquid pump 1A (Step S1). The above-described operations to Step S1 are performed from Step S1 onward.

In the engine pump 1 placed in the upstream position, after the liquid pump 1A is started to be driven in Step S1, the second driving stop controlling unit 153 monitors an accumulated delivery amount of the liquid pump 1A and determines whether a difference between the accumulated delivery amount and the volumetric capacity of the container 4E stored in the RAM becomes equal to or smaller than the third threshold.

When the difference becomes equal to or smaller than the third threshold (Step S25), the second driving stop controlling unit 153 stops the general purpose engine 11 to stop driving the liquid pump 1A (Step S26).

In the engine pump 1 placed in the middle position, after the liquid pump 1A is started to be driven in Step S4, the second driving stop controlling unit 153 monitors an accumulated delivery amount of the liquid pump 1A and determines whether a difference between the accumulated delivery amount and the volumetric capacity of the container 4E stored in the RAM becomes equal to or smaller than the third threshold.

When this difference becomes equal to or smaller than the third threshold (Step S27), the second driving stop controlling unit 153 stops the general purpose engine 11 to stop driving the liquid pump 1A (Step S28).

In the engine pump 1 placed in the downstream position, after the liquid pump 1A is started to be driven in Step S9, the second driving stop controlling unit 153 monitors an accumulated delivery amount of the liquid pump 1A and determines whether a difference between the accumulated delivery amount and the volumetric capacity of the container 4E stored in the RAM becomes equal to or smaller than the third threshold.

When the difference becomes equal to or smaller than the third threshold (Step S29), the second driving stop controlling unit 153 stops the general purpose engine 11 to stop driving the liquid pump 1A (Step S30).

Thus, as has been described heretofore, according to the liquid transferring system 100 including the ECUs 14 of the modified example shown in FIG. 5, in each of the engine pumps 1, the liquid pump 1A is automatically stopped at a point in time when the accumulated delivery amount of the liquid pump 1A becomes almost the same as the volumetric capacity of the container 4E. Accordingly, the necessity of involving the working person to stop manually the liquid pumps 1A can be avoided, so that the working efficiency can be improved.

Inputting the information on the volumetric capacity of the container 4E into one of the engine pumps 1 enables the information to be transferred to and stored in all the other engine pumps 1. Accordingly, the necessity of inputting the volumetric capacity information into each of the engine pumps 1 can be avoided, so that the working efficiency can be improved.

The present invention is not limited to the embodiment that has been described heretofore and can be modified or improved as required. For example, liquid to be transferred by the liquid transferring system 100 is not limited to water, and the liquid transferring system 100 may be applied to transfer of oil.

The present invention further provides illustrative embodiments as follows.

(1) A control device for a general purpose engine in a system (for example, a liquid transferring system 100 in an embodiment described below) including a plurality of liquid pumps (for example, liquid pumps 1A in the embodiment) that are placed to be spaced from one another and a plurality of general purpose engines (for example, general purpose engines 11 in the embodiment) for driving the plurality of liquid pumps, respectively, wherein liquid existing in a first place (for example, a river RV in the embodiment) is transferred to a second place (for example, a container 4E in the embodiment) by transferring the liquid through the liquid pumps and at least one container (for example, containers 2E, 3E in the embodiment) alternately, the control device comprising:

a communication interface (for example, a communication I/F 13 in the embodiment) configured to communicate with another control device for another general purpose engine; and a start instruction information sending unit (for example, a start instruction information sending unit 142 in the embodiment) configured to send, after a first liquid pump that is to be driven by the own control device is started to be driven, start instruction information to a second control device that drives a second liquid pump placed adjacent to a downstream side of the first liquid pump in a transferring direction of the liquid to instruct the second control device to start driving of the second liquid pump based on information indicating a driving record of the first liquid pump, wherein the second liquid pump is started to be driven by the second control device that receives the start instruction information.

According to (1), the start instruction information instructing to start driving of the second liquid pump placed adjacent to the downstream side of the first liquid pump in the transferring direction of the liquid is sent to the second control device that drives the second liquid pump based on the driving record of the first liquid pump, and the second liquid pump is started to be driven by the second control device that receives the start instruction information. Accordingly, the necessity of the working person operating the liquid pumps placed to be spaced from one another to start driving of them can be avoided, so that the working efficiency can be improved.

(2) The control device for the general purpose engine according to (1), further comprises:

a start instruction information receiving unit (for example, a start instruction information receiving unit 143 in the embodiment) configured to receive start instruction information indicating a start of driving the first liquid pump from a third control device that drives a third liquid pump placed adjacent to an upstream side of the first liquid pump in the transferring direction of the liquid; and a driving start controlling unit (for example, a driving start controlling unit 144 in the embodiment) configured to start driving of the first liquid pump when the start instruction information is received.

According to (2), the liquid pump is started to be driven when the start instruction information is received from another control device, so that electric power can be prevented from being consumed wastefully. Additionally, efficient work can be performed.

(3) The control device for the general purpose engine according to (1) or (2), further comprises:

a fuel amount detecting unit (for example, a fuel amount detecting unit 145 in the embodiment) configured to detect an amount of fuel remaining in the general purpose engine; and a stop instruction information sending unit (for example, a stop instruction information sending unit 146 in the embodiment) configured to send stop instruction information to the control devices that respectively drive all the liquid pumps that are placed on an upstream side of the first liquid pump in the transferring direction of the liquid when the amount of fuel is reduced to be below a threshold while the first liquid pump is being driven, wherein driving of all the liquid pumps on the upstream side is stopped by the control devices that receive the stop instruction information.

According to (3), when a small amount of fuel is left, the information instructing to stop the liquid pump is sent to the control device in the upstream position, and the liquid pump in the upstream position is stopped by the control device that receives the information. Accordingly, liquid can be prevented from overflowing the container even when a lack of fuel occurs in the general purpose engine driving the liquid pump.

(4) The control device for the general purpose engine according to (3), further comprises:

a first driving stop controlling unit (for example, a first driving stop controlling unit 148 in the embodiment) configured to stop driving of the first liquid pump when receiving stop instruction information instructing to stop the first liquid pump is received from another control device.

According to (4), the driving of the liquid pump is stopped when the stop instruction information is received from another control device. Accordingly, liquid can be prevented from overflowing from the container that is a destination to which the liquid is transferred by the liquid pump.

(5) The control device for the general purpose engine according to any one of (1) to (4), further comprises:

a delivery capacity information receiving unit (for example, a delivery capacity information receiving unit 149 in the embodiment) configured to receive information on a delivery capacity of liquid of the second liquid pump from the second control device after the second liquid pump is started to be driven; and a delivery capacity controlling unit (for example, a delivery capacity controlling unit 150 in the embodiment) configured to control a delivery capacity of the first liquid pump based on the delivery capacity information.

According to (5), the delivery capacity of the liquid pump is controlled based on the delivery capacity of the liquid pump in the downstream position, and accordingly, an efficient transfer of liquid can be realized.

(6) The control device for the general purpose engine according to any one of (1) to (5), wherein the second place has a container, and further comprises:

an input interface (for example, an operating unit 15 in the embodiment) to which information is inputted;

a memory controlling unit (for example, a memory controlling unit 151 in the embodiment) configured to store, in either of a case where information on a volumetric capacity of the container of the second place is inputted via the input interface and a case where the volumetric capacity information is received from another control device via the communication interface, the volumetric capacity information to a storage memory;

a second driving stop controlling unit (for example, a second driving stop controlling unit 153 in the embodiment) configured to stop driving of the first liquid pump in a case where a difference between a total amount of liquid that has been delivered by the first liquid pump and the volumetric capacity that is stored in the storage memory is equal to or smaller than a threshold; and a volumetric capacity information sending unit (for example, a volumetric capacity information sending unit 152 in the embodiment) configured to send the volumetric capacity information to another control device.

According to (6), the liquid pump can be stopped automatically, so that the working efficiency can be improved. Additionally, wasteful operations can be reduced to realize conservation of energy.

DESCRIPTION OF REFERENCE NUMERALS AND CHARACTERS

100 Liquid transferring system
1 Engine pump
1A Liquid pump
1B Engine system
1C, 1D, 2C, 2D, 3C, 3D Hose
2E, 3E, 4E Container
RV River
11 General purpose engine
13 Communication interface
14 ECU
15 Operating unit
21 Pump mechanism
22 Flow rate sensor
30 Bus
141 Engine controlling unit

142 Start instruction information sending unit
143 Start instruction information receiving unit
144 Driving start controlling unit
145 Fuel amount detecting unit
146 Stop instruction information sending unit
147 Delivery capacity information sending unit
148 First driving stop controlling unit
149 Delivery capacity information receiving unit
150 Delivery capacity controlling unit
151 Memory controlling unit
152 Volumetric capacity information sending unit
153 Second driving stop controlling unit

The invention claimed is:

1. A control device for a general purpose engine in a system, the system including:

a plurality of liquid pumps, including a first liquid pump and a second liquid pump, that are placed to be spaced from one another, a plurality of general purpose engines, including the general purpose engine and other general purpose engines, for driving the plurality of liquid pumps respectively, and a plurality of control devices, including the control device and other control devices, for the plurality of general purpose engines respectively, wherein liquid existing in a first place is transferred to a second place by transferring the liquid through the liquid pumps and at least one container alternately, the control device comprising:

a communication interface configured to communicate with the other control devices for the other general purpose engines;

a start instruction information sending processor configured to send, after the first liquid pump that is to be driven by the general purpose engine that is to be controlled by the control device is started to be driven, start instruction information to a second control device of the other control devices that drives the second liquid pump placed adjacent to a downstream side of the first liquid pump in a transferring direction of the liquid to instruct the second control device to start driving of the second liquid pump when information indicating a driving record of the first liquid pump reaches a threshold, wherein the second liquid pump is started to be driven by the second control device that receives the start instruction information;

a fuel amount detecting processor configured to detect an amount of fuel remaining in the general purpose engine; and a stop instruction information sending processor configured to send stop instruction information to control devices of the other control devices that respectively drive all liquid pumps of the plurality of liquid pumps that are placed on an upstream side of the first liquid pump in the transferring direction of the liquid when the amount of fuel is reduced to be below a threshold while the first liquid pump is being driven, wherein driving of all the liquid pumps on the upstream side is stopped by the control devices that receive the stop instruction information.

2. The control device for the general purpose engine according to claim 1, further comprising:

a start instruction information receiving processor configured to receive start instruction information instructing a start of driving the first liquid pump from a third control device of the other control devices that drives a third liquid pump placed adjacent to an upstream side of the first liquid pump in the transferring direction of the liquid; and a driving start controlling processor configured to start driving of the first liquid pump when the start instruction information is received.

3. The control device for the general purpose engine according to claim 1, further comprising:

a first driving stop controlling processor configured to stop driving of the first liquid pump when stop instruction information instructing to stop the first liquid pump is received from another control device of the other control devices.

4. The control device for the general purpose engine according to claim 1, further comprising:

a delivery capacity information receiving processor configured to receive information on a delivery capacity of liquid of the second liquid pump from the second control device after the second liquid pump is started to be driven; and a delivery capacity controlling processor configured to control a delivery capacity of the first liquid pump based on the delivery capacity information.

5. The control device for the general purpose engine according to claim 1, wherein the second place has a container, the control device further comprising:

an input interface to which information is inputted;

a memory controlling processor configured to store, in either of a case where information on a volumetric capacity of the container of the second place is inputted via the input interface and a case where the volumetric capacity information is received from one of the other control devices via the communication interface, the volumetric capacity information to a storage memory;

a driving stop controlling processor configured to stop driving of the first liquid pump in a case where a difference between a total amount of liquid that has been delivered by the first liquid pump and the volumetric capacity that is stored in the storage memory is equal to or smaller than a threshold; and a volumetric capacity information sending processor configured to send the volumetric capacity information to another one of the other control devices.

6. The control device for the general purpose engine according to claim 2, further comprising:

a delivery capacity information receiving processor configured to receive information on a delivery capacity of liquid of the second liquid pump from the second control device after the second liquid pump is started to be driven; and a delivery capacity controlling processor configured to control a delivery capacity of the first liquid pump based on the delivery capacity information.

7. The control device for the general purpose engine according to claim 3, further comprising:

a delivery capacity information receiving processor configured to receive information on a delivery capacity of liquid of the second liquid pump from the second control device after the second liquid pump is started to be driven; and a delivery capacity controlling processor configured to control a delivery capacity of the first liquid pump based on the delivery capacity information.

8. The control device for the general purpose engine according to claim 2, wherein the second place has a container, the control device further comprising:

an input interface to which information is inputted;

a memory controlling processor configured to store, in either of a case where information on a volumetric capacity of the container of the second place is inputted via the input interface and a case where the volumetric capacity information is received from one of the other control devices via the communication interface, the volumetric capacity information to a storage memory;

a driving stop controlling processor configured to stop driving of the first liquid pump in a case where a difference between a total amount of liquid that has been delivered by the first liquid pump and the volumetric capacity that is stored in the storage memory is equal to or smaller than a threshold; and a volumetric capacity information sending processor configured to send the volumetric capacity information to another one of the other control devices.

9. The control device for the general purpose engine according to claim 3, wherein the second place has a container, the control device further comprising:

an input interface to which information is inputted;

a memory controlling processor configured to store, in either of a case where information on a volumetric capacity of the container of the second place is inputted via the input interface and a case where the volumetric capacity information is received from one of the other control devices via the communication interface, the volumetric capacity information to a storage memory;

a second driving stop controlling processor configured to stop driving of the first liquid pump in a case where a difference between a total amount of liquid that has been delivered by the first liquid pump and the volumetric capacity that is stored in the storage memory is equal to or smaller than a threshold; and a volumetric capacity information sending processor configured to send the volumetric capacity information to another one of the other control devices.

* * * * *